US006382940B1

(12) United States Patent
Blume

(10) Patent No.: US 6,382,940 B1
(45) Date of Patent: May 7, 2002

(54) HIGH PRESSURE PLUNGER PUMP HOUSING AND PACKING

(76) Inventor: George H. Blume, 107 Morning Cloud Cove, Austin, TX (US) 78734

( * ) Notice: Subject to any disclaimer, the term of this patent is extended or adjusted under 35 U.S.C. 154(b) by 0 days.

(21) Appl. No.: 09/618,693

(22) Filed: Jul. 18, 2000

(51) Int. Cl.[7] ..... F04B 39/10

(52) U.S. Cl. ..... 417/571; 417/568; 417/567; 417/454; 277/435; 277/520; 92/169.1

(58) Field of Search ..... 417/571, 567, 417/568, 559, 540, 454; 277/367, 370, 529, 342, 520, 435, 437, 439; 92/169.1, 171.1

(56) References Cited

U.S. PATENT DOCUMENTS 3,907,307 A * 9/1975 Maurer et al. ..... 277/69
4,456,440 A * 6/1984 Korner ..... 417/540
4,527,961 A * 7/1985 Redwine et al. ..... 417/454
4,573,886 A * 3/1986 Maasberg et al. ..... 417/454
4,878,815 A * 11/1989 Stachowiak ..... 417/63
5,145,340 A * 9/1992 Allard ..... 417/568
5,924,853 A * 7/1999 Pacht ..... 417/567

* cited by examiner

*Primary Examiner*—Charles G. Freay
*Assistant Examiner*—Han L. Liu
(74) *Attorney, Agent, or Firm*—Dennis W. Gilstad

(57) ABSTRACT

A Y-block fluid section plunger pump housing has a cylinder bore which is transversely elongated at its intersection with suction and discharge bores to provide stress relief and a reduction in housing weight. An integral suction valve retainer arm further reduces stress near the bore intersection. Tapered cartridge packing assemblies facilitate use of a one-piece plunger in Y-block housings and also allow packing in such housings to be changed without removing the plunger.

12 Claims, 15 Drawing Sheets

HIGH PRESSURE PLUNGER PUMP HOUSING AND PACKING

FIELD OF THE INVENTION

The invention relates generally to high-pressure plunger pumps used, for example, in oil field operations. More particularly, the invention relates to plunger packing and stress reduction in plunger pump housings.

BACKGROUND OF THE INVENTION

Plunger Pump Stress Failure

Engineers typically design high-pressure oil field plunger pumps in two sections; the (proximal) power section and the (distal) fluid section. The power section usually comprises a crankshaft, reduction gears, bearings, connecting rods, crossheads, crosshead extension rods, etc, The fluid section usually comprises a housing which in turn comprises suction, discharge and cylinder bores, plus plungers, packing, valves, seats, high-pressure seals, etc. FIG. 1 is a cross-sectional schematic view of a typical fluid section showing its connection to a power section by stay rods. A plurality of fluid sections similar to that illustrated in FIG. 1 may be combined, as suggested in the Triplex fluid section design schematically illustrated in FIG. 2.

Each individual bore in a fluid section housing is subject to fatigue due to alternating high and low pressures which occur with each stroke of the plunger cycle. Fluid section housings typically fail due to fatigue cracks in one of the four areas defined by the intersecting suction, plunger and discharge bores as schematically illustrated in FIG. 3.

Among the designs proposed in the past for reducing pump housing fatigue failures in high-pressure fluid sections has been the Y-block housing design. The Y-block design, which is schematically illustrated in FIG. 4, reduces stress concentration in a fluid section housing by increasing the angles of bore intersections above 90°. In the illustrated example of FIG. 4, the bore intersection angles are approximately 120°. A more complete cross-sectional view of a Y-block plunger pump fluid section is schematically illustrated in FIG. 5.

Although several variations of the Y-block design have been evaluated, none have become commercially successful for several reasons. One such reason is that mechanics find field maintenance on Y-block fluid sections difficult. For example, replacement of plungers and/or plunger packing is significantly more complicated in Y-block designs than in the earlier designs represented in FIG. 1. In the earlier designs, provision is made to push the plunger distally in the cylinder bore, continuing out through an access port labeled the suction valve/plunger cover in the illustration. This operation, which would leave the plunger packing easily accessible from the proximal end of the cylinder bore, is impossible in a Y-block design.

The Y-block configuration, while reducing stress in a fluid section housing, makes it necessary to remove the plunger from the proximal end of the cylinder bore. But because the proximal end of the cylinder bore is very close to the power section, plungers must be removed in two pieces. And even a two-piece plunger, schematically illustrated in FIG. 5, is itself a maintenance problem. The plunger pieces are often heavy and slippery, the connection between plunger pieces is subject to premature failures, and plunger pieces must be connected and disconnected in a confined space with limited visibility and accessibility. Nevertheless, the plunger pieces must be removed entirely from the cylinder bore in order to change conventional plunger packing.

Plunger Packing

A brief review of plunger packing design will illustrate some of the problems associated with packing and plunger maintenance in Y-block fluid sections. FIG. 6 is an enlarged view of the packing in an earlier (but still currently used) fluid section such as that illustrated in FIG. 1. In FIG. 6, the packing and packing brass are installed in the packing box of the fluid section. Note that packing brass is a term used by field mechanics to describe bearing bronze, where the bronze has the appearance of brass.

In the fluid section portion schematically illustrated in FIG. 6, the packing box is an integral part of the fluid section housing; it may also be a separate unit bolted to the fluid section housing. The packing is retained, tightened and adjusted by turning the gland nut. Removing the gland nut, however, does not allow one to remove the packing rings. Because packing rings must block high-pressure fluid leakage past the plunger, they are typically quite stiff, and they remain substantially inaccessible while the plunger (or any piece of it) remains in the cylinder bore. FIG. 7 schematically illustrates portions of a plunger pump housing and components including a gland nut and plunger parts, with the plunger pressure end within the packing box. Note, however, that the plunger pressure end cannot be rotated for removal until it clears the packing brass. This illustrates the necessity for a two-piece plunger in which the two pieces must be separated as they are individually removed from the cylinder bore.

The necessity for a multi-piece plunger in Y-block fluid section housings has not been eliminated by the recent introduction of packing assemblies such as those called "cartridge packing" by UTEX Industries in Houston, Tex. An example of such cartridge packing is schematically illustrated in FIG. 8. Note that removal of the gland nut exposes the packing cartridge housing, which in turn may be fitted with attachment means to allow extraction of the packing cartridge from the packing box (requiring proximal travel of the packing cartridge housing of approximately three to five inches).

This extraction, though, is not practical while a plunger piece lies within the packing box because of the excessive drag of the compressed packing rings on the plunger and packing box walls. Such compression can not be released unless all plunger pieces are removed from the packing box because the packing rings in the above cartridge packing assemblies are pre-compressed when the assemblies are manufactured. Further, any slight misalignment of apparatus used to extract such a cartridge packing assembly tends to cause binding of the (right cylindrical, i.e., not tapered) assembly within the (right cylindrical) bore. Analogous difficulties occur if an attempt is made to replace such a cartridge packing assembly while a plunger or part thereof lies in the packing box area. Hence, even if such cartridge packing assemblies were used in Y-block fluid section housings, multi-piece plungers would preferably be used and field maintenance would be significantly complicated and expensive.

SUMMARY OF THE INVENTION

The invention comprises methods and apparatus to reduce or eliminate the above described problems of premature fluid section pump housing fatigue failure and difficult field maintenance related to plungers and/or plunger packing. In a preferred embodiment of the invention, a Y-block plunger pump housing comprises a suction valve bore having a substantially circular cross-section and a first centerline. Bore centerlines are used herein to assist the reader in understanding how each bore in the fluid section pump housing is spatially related to other bores in the pump housing and other fluid section components.

A discharge valve bore intersects said suction valve bore, said discharge valve bore having a substantially circular cross-section and a second centerline, said first centerline preferably being coplanar with and intersecting said second centerline at a reference point, and said first and second centerlines subtending a first obtuse angle.

A cylinder bore intersects said suction valve bore and said discharge valve bore, said cylinder bore having a proximal packing area (relatively nearer the power section) and a distal transition area (relatively more distant from the power section). The packing area has a substantially circular cross-section and a third centerline. The third centerline is coplanar with said first and second centerlines and intersects them at or near said reference point to allow substantially unimpeded fluid flow from said suction bore to said discharge bore under the influence of reciprocating plunger movement in said cylinder bore. Said second and third centerlines subtend a second obtuse angle, and said first and third centerlines subtend a third obtuse angle. Preferred values for the first, second and third obtuse angles, as well as preferred intersections of the first, second and third bore centerlines, are determined primarily by design guidelines which minimize materials and machining costs. Such guidelines are well known to those skilled in the art.

The transition area of the cylinder bore has a distal elongated cross-section substantially perpendicular to said third centerline and with a long axis substantially perpendicular to the plane of said first, second, and third centerlines. Modern computer-aided finite element stress analysis (FEA) was used to study stress concentrations in the fluid section pump housing design of the present invention and to document the advantages of the above elongated cross-section. Past Y-block pump housing designs, on the other hand, experienced premature fatigue-induced cracks due to stress concentrations that could not be predicted without computers and modern FEA software.

Note that FEA reveals that elongation of the distal portion of the cylinder bore transition area as described above is generally beneficial in reducing stress near the intersections of the cylinder bore transition area with the suction and discharge bores. The shape of the elongation, however, may be optimized to obtain the greatest stress reduction. For example, while an elliptical cross-section is beneficial, an oblong cross-section is more beneficial.

The cross-section of an oblong bore consists of two opposing half-circles connected by substantially straight lines, which leaves a substantially flat area between the cylindrical sections of the oblong bore. These substantially straight lines preferably have length between 5% and 95% of the length of radii of the opposing half circles. The unexpected result of incorporating such an oblong bore is that stresses in all areas of the intersecting bores of the present invention are significantly reduced. Note that stresses are reduced in spite of the fact that pump housing material is removed and the fluid section side wall thickness is reduced in the area of the oblong bore, which would ordinarily be expected to increase stress concentrations rather than reduce them.

An explanation of this surprising phenomenon lies in the intersection of the suction and discharge bores with the flat area of the oblong bore, which (FEA analysis shows) disperses stresses along the flat area. Note that the presence of the flat area effectively increases any discrete angles of intersection between the suction and discharge bores and the cylinder bore. Indeed, by tapering the oblong cylinder bore to flare out from proximal to distal, the transition from either the suction or discharge bore to the right cylindrical portion of the cylinder bore can be made nearly smooth. In contrast, earlier (circular) cylinder bores tend to concentrate stresses where they intersect with circular suction and discharge bores, discrete angles of intersection being relatively smaller than in the present invention.

Another preferred embodiment of the present invention relates to a tapered cartridge packing assembly comprising a packing cartridge housing and related components. The packing cartridge housing has a distal end, a proximal end, a longitudinal axis, and a length between said distal and proximal ends. A substantially right cylindrical inner surface of the cartridge housing has a first diameter, and a substantially coaxial right cylindrical outer surface extends distally from said proximal end for a portion of said cartridge housing length. A conically tapered substantially coaxial outer surface extends distally from said distal extent of said right cylindrical outer surface to said cartridge housing distal end, said tapered outer surface tapering distally from said right cylindrical outer surface toward said longitudinal axis. The inner surface has a substantially coaxial cylindrical recess having a second diameter greater than said first diameter and extending from said distal end proximally to an internal anti-extrusion ring stop. The cylindrical recess has a substantially coaxial internal snap ring groove, said groove having a substantially uniform width and a third diameter greater than said second diameter.

There is at least one circumferential seal groove in said right cylindrical outer surface, and an elastomeric seal is fitted within each said circumferential seal groove. A substantially coaxial bearing ring lies within the cylindrical recess; it has an inner diameter slightly less than said first diameter and an outer diameter about equal to said second diameter. The bearing ring contacts said bearing ring stop. A substantially coaxial anti-extrusion ring also lies within the cylindrical recess. The anti-extrusion ring contacts said bearing ring. With an inner diameter slightly less than said first diameter and an outer diameter about equal to said second diameter, the anti-extrusion ring has a close sliding fit against a plunger in the cylinder bore, thereby effectively preventing extrusion of plunger packing proximally.

A substantially coaxial snap ring having a thickness less than said snap ring groove width lies within the snap ring groove. The snap ring has an inner diameter slightly greater than said first diameter and an outer diameter slightly less than said third diameter, said snap ring having a longitudinal sliding fit within said snap ring groove.

A substantially coaxial packing compression ring has an inner diameter slightly greater than said first diameter, an outer diameter slightly less than said second diameter, and a thickness preferably greater than said snap ring groove width reduced by the snap ring thickness. The packing compression ring is positioned between said snap ring and said anti-extrusion ring and contacts said snap ring but is too thick to become lodged in said snap ring groove when the snap ring is in place in the groove.

A substantially coaxial packing ring lies within said cylindrical recess. The packing ring has an inner diameter substantially equal to said first diameter and an outer diameter substantially equal to said second diameter. It has sufficient length to substantially fill said recess between said anti-extrusion ring and said packing compression ring when said snap ring is positioned maximally distally within said snap ring groove. Note that proximally directed longitudinal sliding movement of said snap ring within said snap ring groove causes proximally directed longitudinal sliding movement of said packing compression ring with resultant compression of said packing.

A tapered cartridge packing assembly of the present invention is advanced distally into the tapered recess of the packing area of a cylinder bore of a plunger pump housing of the present invention through distal motion imparted by tuning a threaded gland nut. The gland nut may be separable from the tapered cartridge packing assembly, but in an alternative preferred embodiment (a tapered cartridge packing and gland nut assembly), the gland nut is integral with the proximal end of the packing cartridge housing. Before being advanced distally, the coaxial packing ring is uncompressed, which means that drag on a plunger which may be within the packing area of the cylinder bore is relatively low. When the packing assembly is nearly fully inserted into the packing area (that is, within a distance from the end of its travel equal to the snap ring groove width), the snap ring encounters a coaxial cylindrical boss of the pump housing, the proximal face of which is termed the adjusting ring. Further (distal) advance of the packing assembly after the snap ring contacts the adjusting ring results in relative proximal longitudinal movement of the snap ring in its groove. This proximal longitudinal movement results in compression of the coaxial packing ring with a consequent tightening of the packing around the plunger.

Because of the shallow taper of a distal portion of its outer surface (preferably in the range of 0.5 to 3 degrees) and the circumferential elastomeric seal present on a proximal portion of that surface, a tapered cartridge packing assembly will maintain an effective seal with a plunger pump housing during longitudinal sliding movement less than or equal in magnitude to the snap ring groove width. Thus, as described above, the degree of tightening of packing around a plunger may be adjusted by varying the distance a packing assembly is advanced into a plunger pump housing of the present invention after the snap ring contacts the adjusting ring. Note that during advance and withdrawal of a packing assembly, the tapered portion tends to maintain alignment with a cylinder bore, thus minimizing any tendency to bind.

Note also that distal advance of a tapered packing assembly or tapered packing and gland nut assembly of the present invention is preferably limited by the snap ring or the gland nut shoulder, rather than by the assembly being wedged tightly into the tapered recess of a cylinder bore packing area. These complementary provisions to limit distal advance also act to minimize binding of the assembly in the tapered recess. Thus, withdrawal of a tapered packing assembly should be substantially free of binding while drag due to packing compression is substantially reduced as the assembly is withdrawn and the snap ring becomes free to move distally in its groove to relieve compression of the packing ring. These effects combine to make changing of packing with a plunger in the cylinder bore practical in the field.

DETAILED DESCRIPTION OF THE INVENTION

Figure 1:
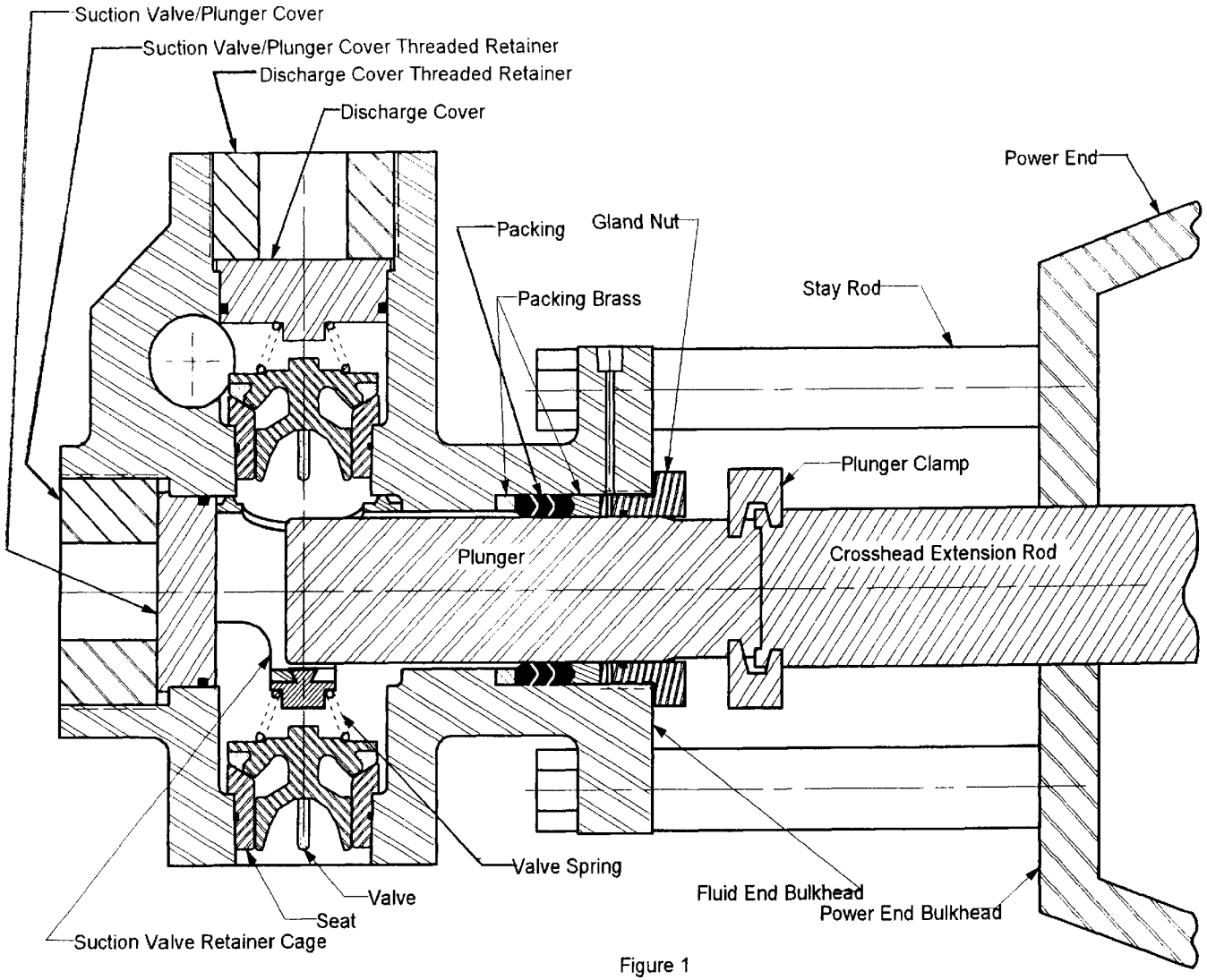
FIG. 1 is a cross-sectional schematic view of a conventional plunger pump fluid section housing showing its connection to a power section by stay rods.
Figure 2:
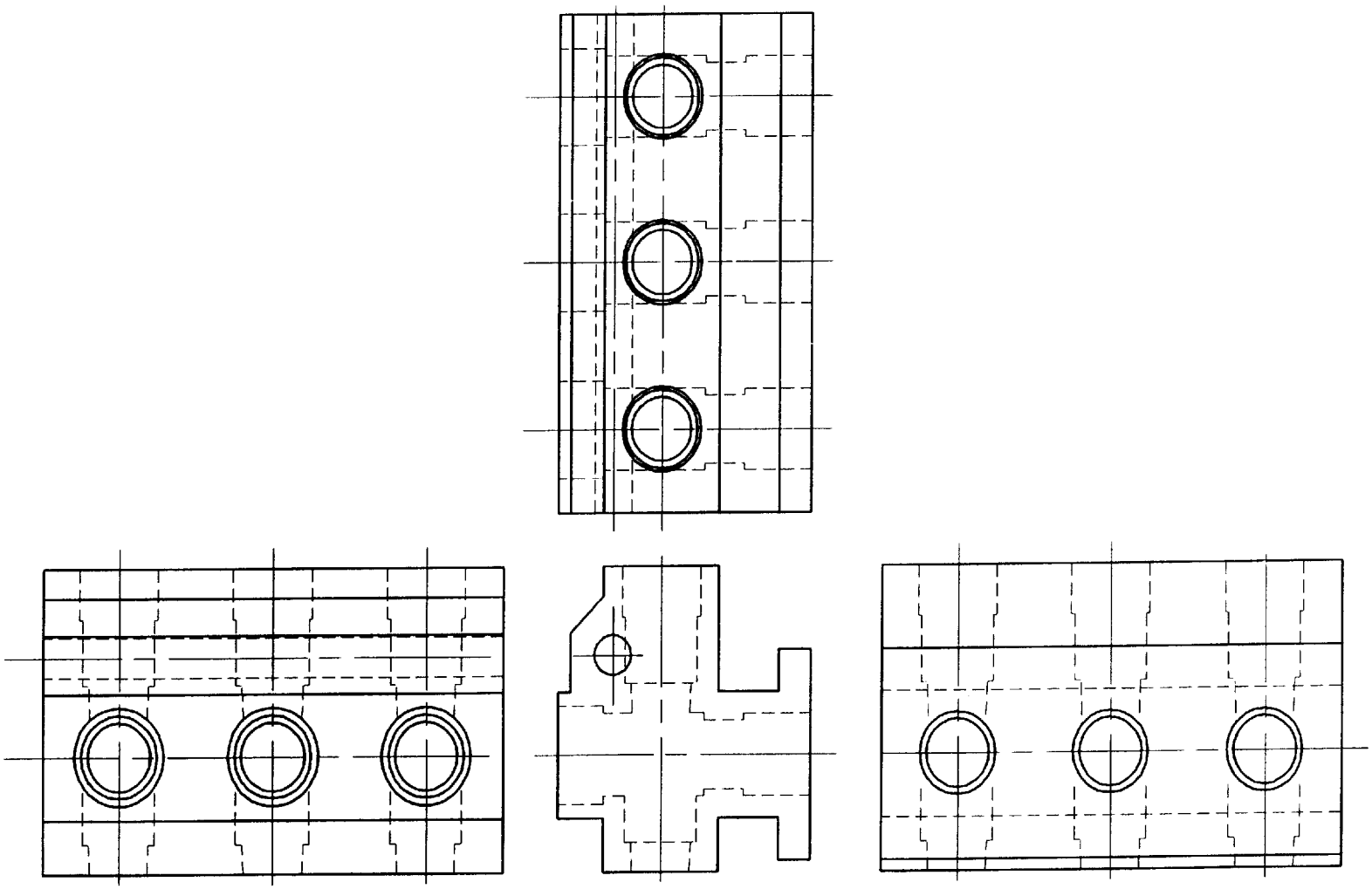
FIG. 2 schematically illustrates a conventional Triplex plunger pump fluid section.
Figure 3:
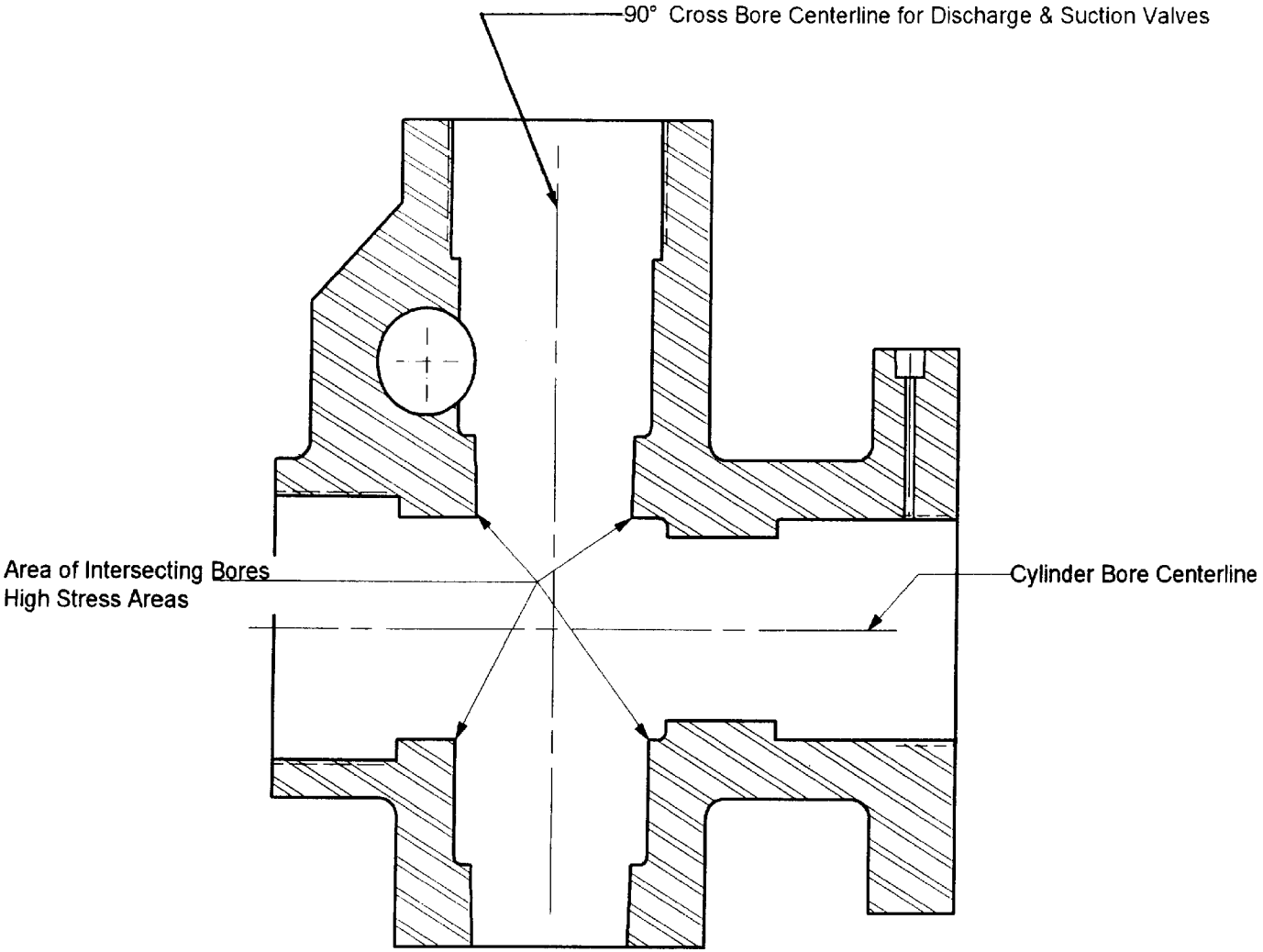
FIG. 3 is a cross-sectional schematic view of suction, plunger and discharge bores of a conventional plunger pump housing intersecting at right angles showing areas of elevated stress.
Figure 4:
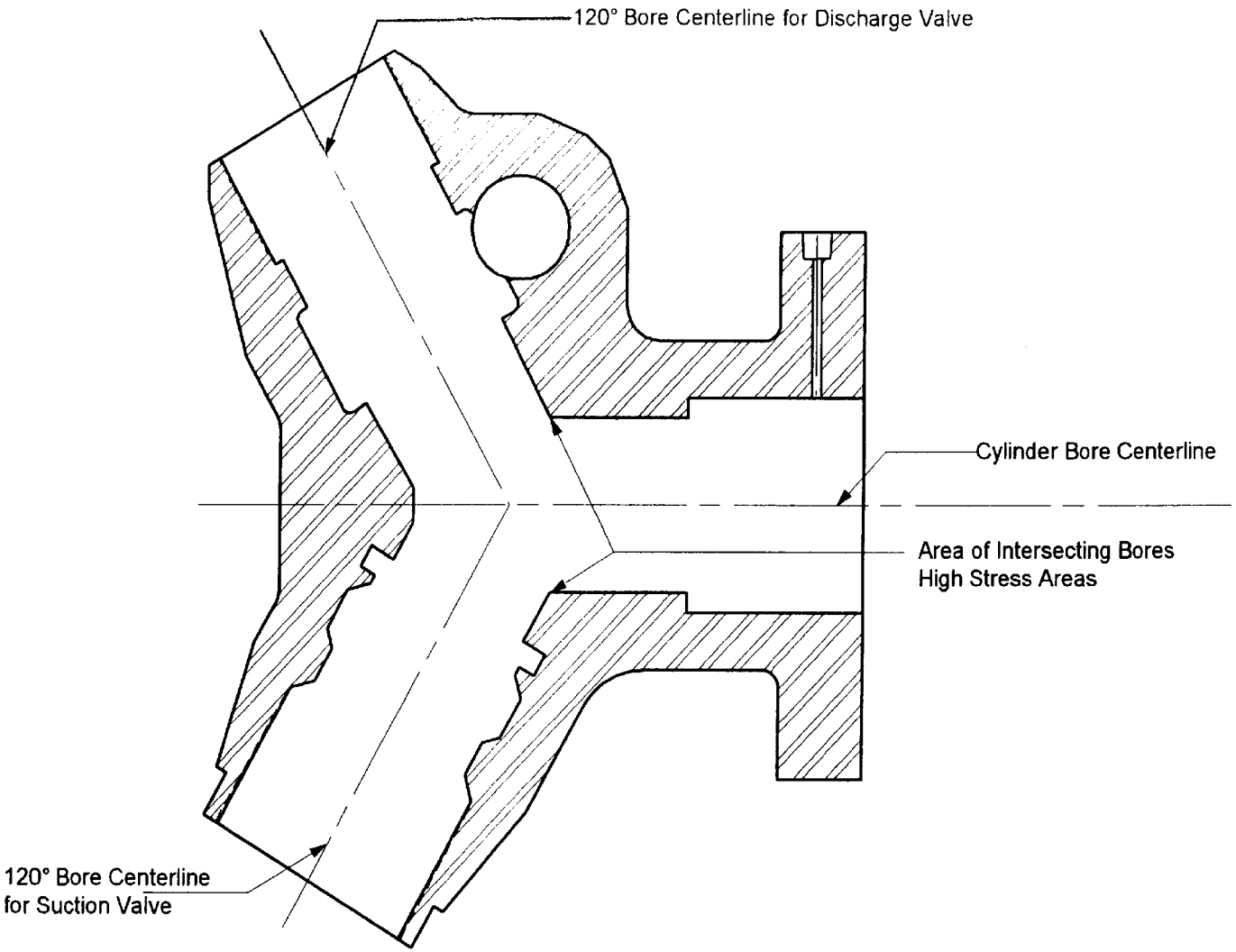
FIG. 4 is a cross-sectional schematic view of suction, plunger and discharge bores of a Y-block plunger pump housing intersecting at obtuse angles showing areas of elevated stress.
Figure 5:
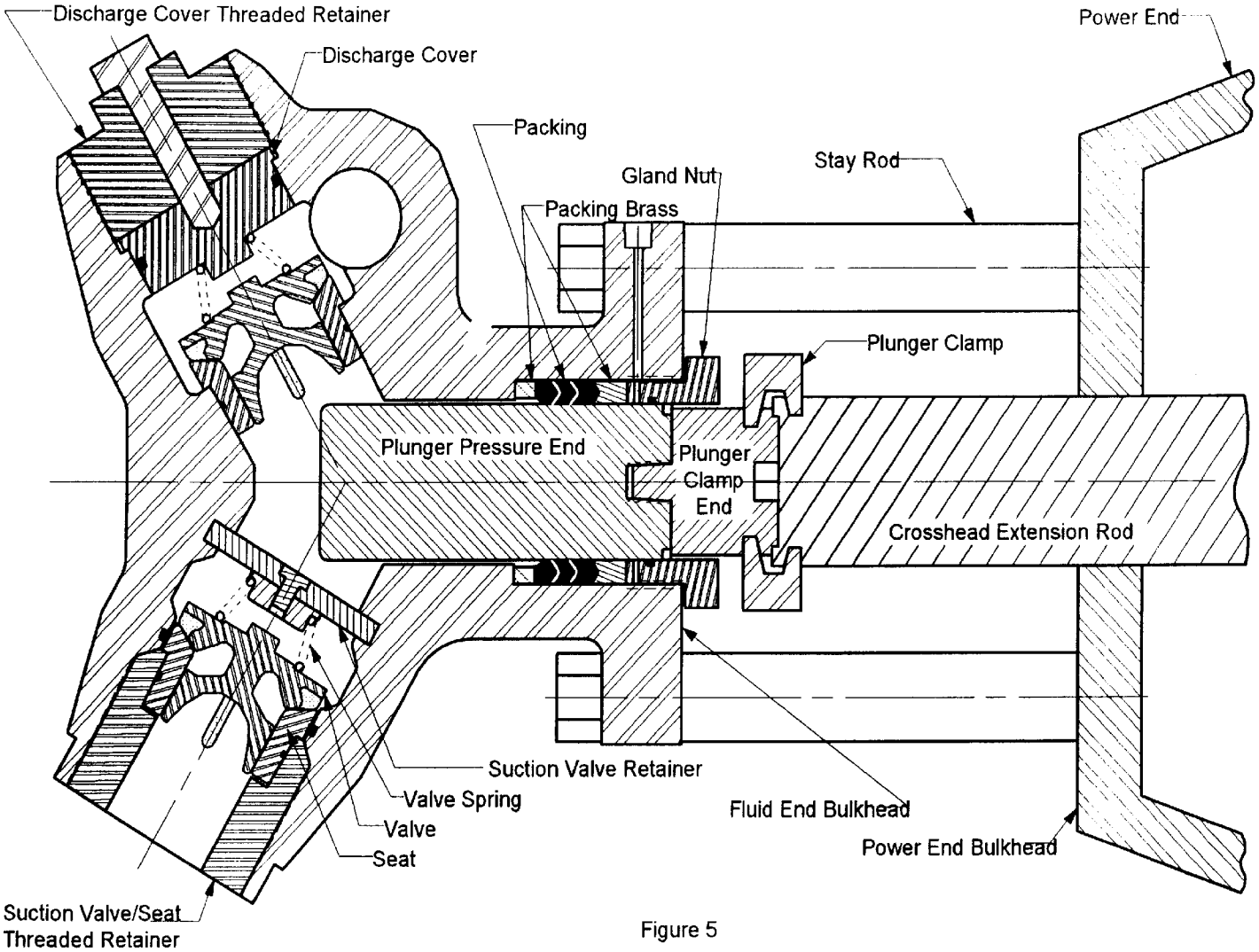
FIG. 5 is a cross-sectional schematic view similar to that in FIG. 4, including internal plunger pump components.
Figure 6:
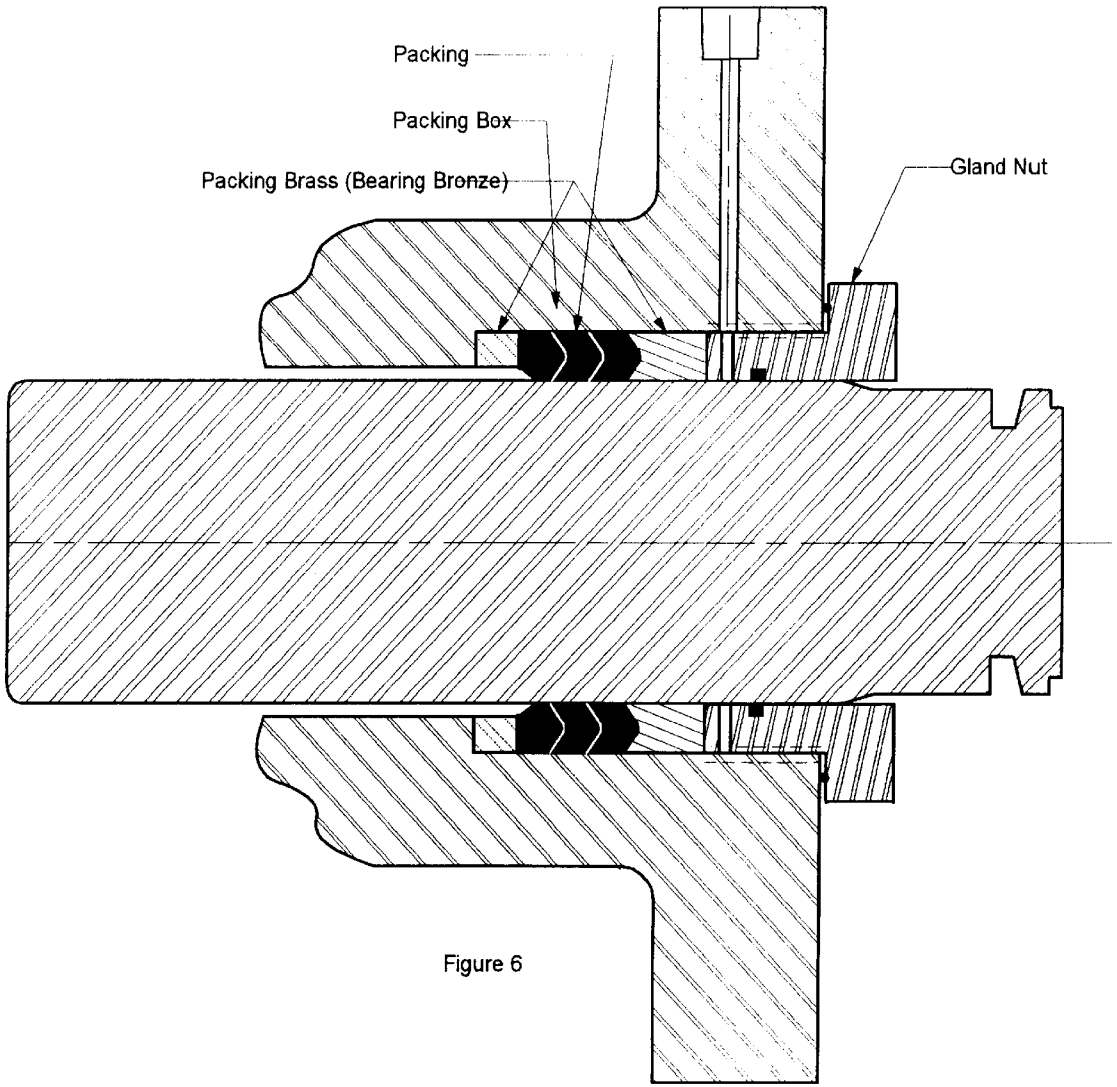
FIG. 6 is a partial cross-sectional schematic view of conventional plunger packing and packing brass.
Figure 7:
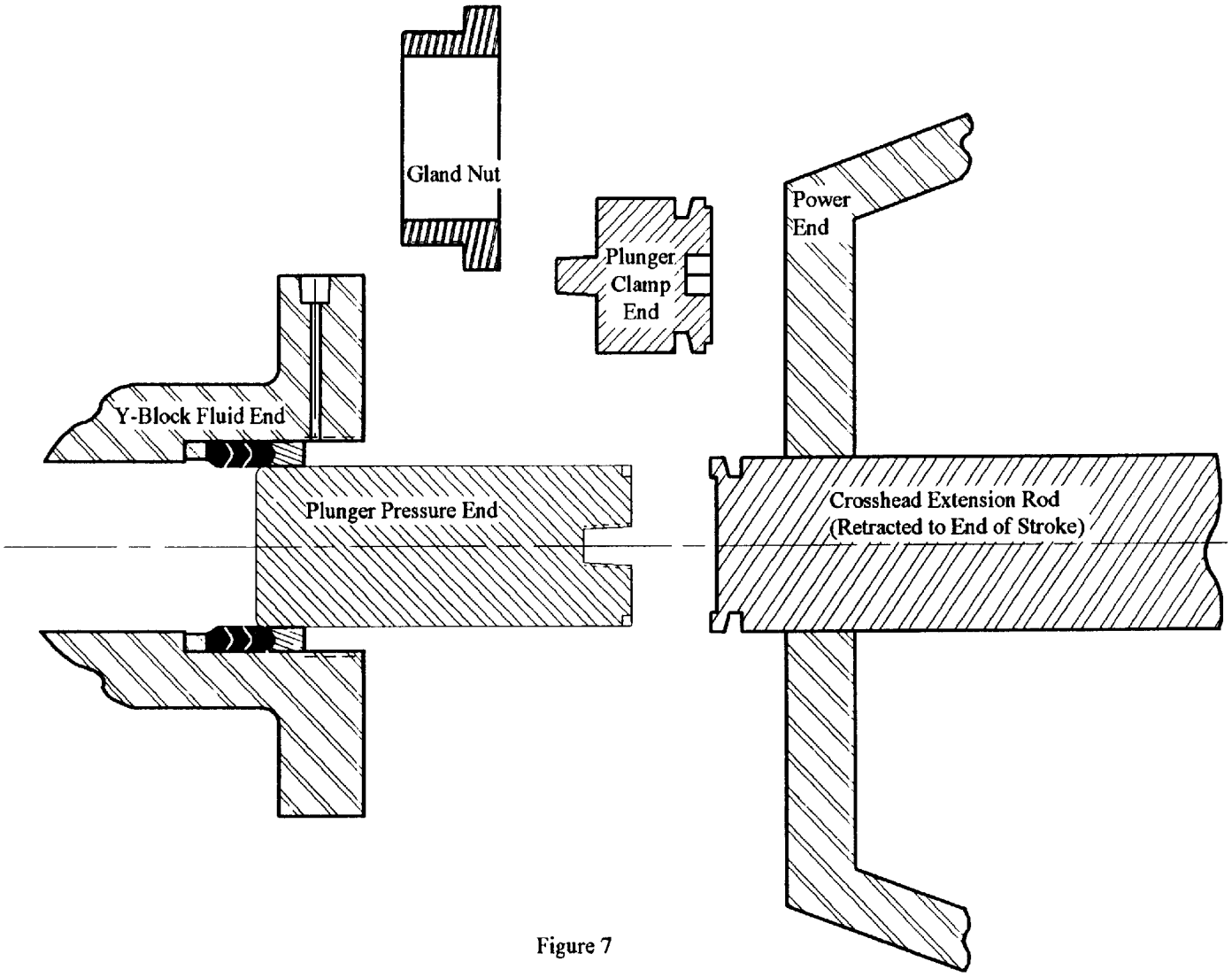
FIG. 7 schematically illustrates portions of a Y-block plunger pump housing, together with a gland nut and plunger parts, with the plunger pressure end within the packing box.
Figure 8:
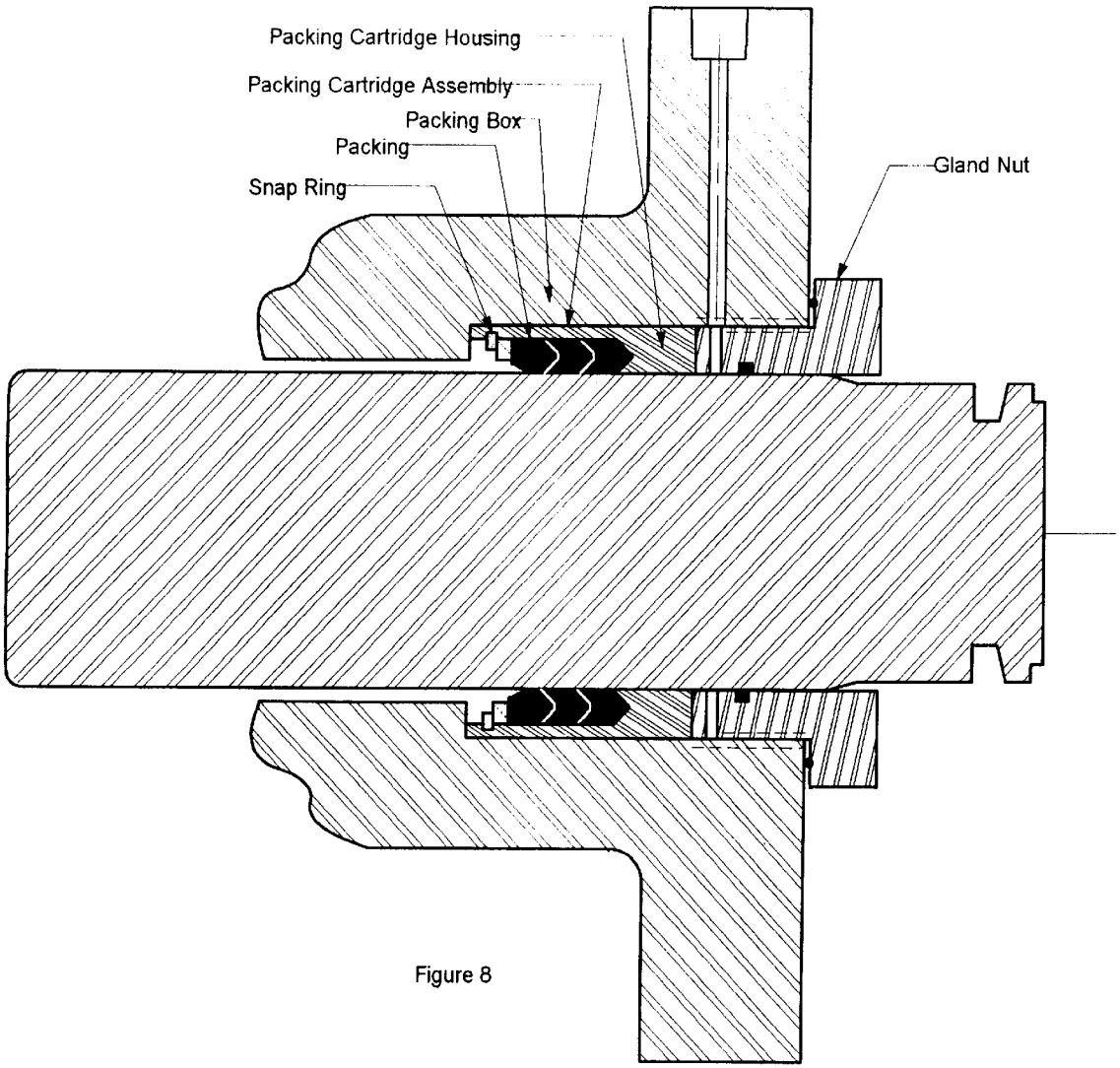
FIG. 8 schematically illustrates a partial cross-sectional view of a plunger pump housing, together with a conventional packing cartridge and gland nut.
Figure 9A:
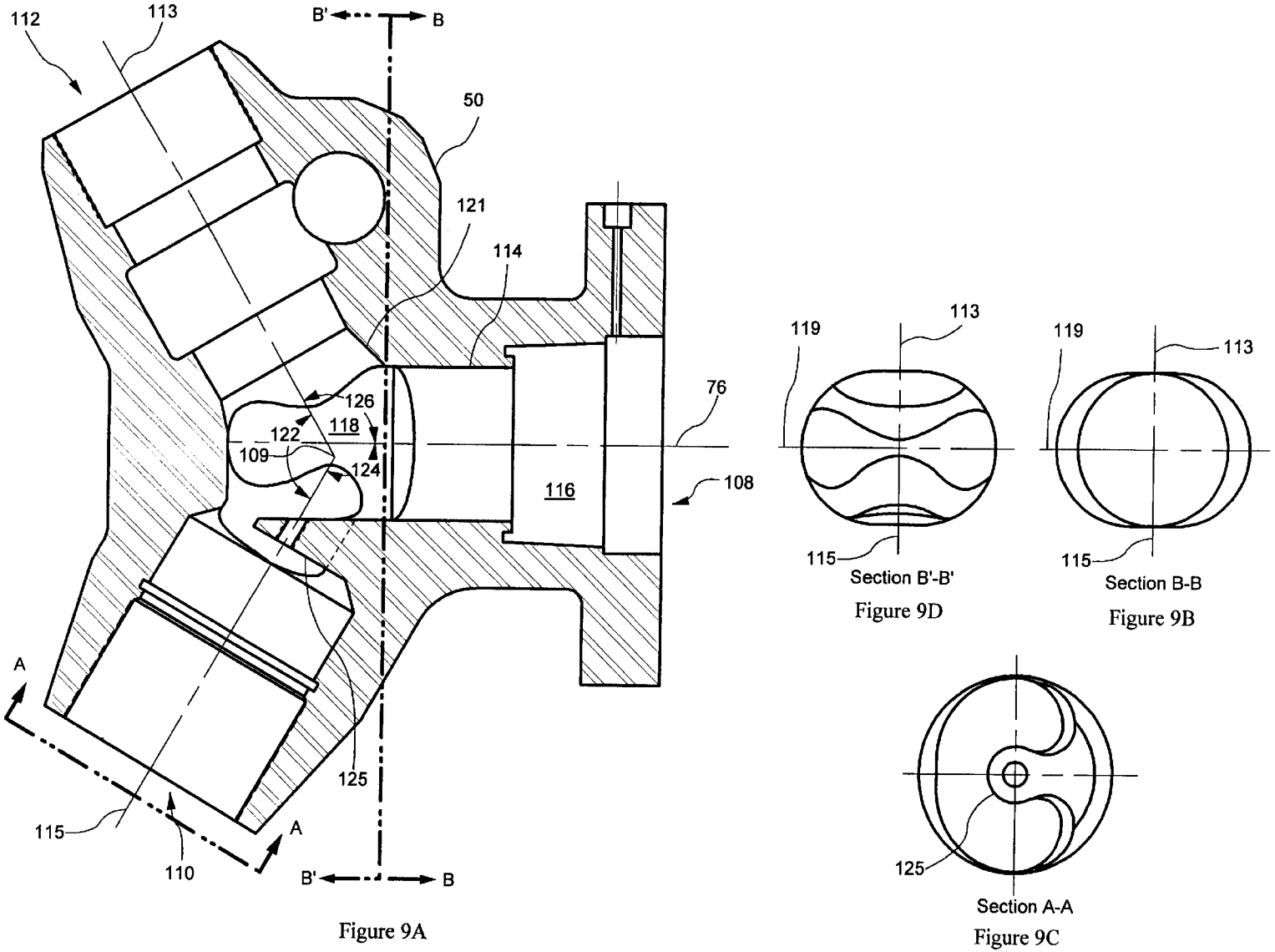
FIG. 9 A, B, C, and D shematically illustrates a cross-sectional view of a Y-block plunger pump housing incorporating an integral suction valve retainer arm, an oblong distal cylinder bore portion, and provision for insertion of a tapered packing cartridge assembly.

FIG. 9 schematically illustrates a cross-sectional view of a Y-block plunger pump housing 50 of the present invention. The housing 50 comprises an integral suction valve retainer arm 125, as well as a suction valve bore 110 having a substantially circular cross-section and a first centerline 115. A discharge valve bore 112 of housing 50 has a substantially circular cross-section and a second centerline 113. Discharge valve bore 112 intersects suction valve bore 110 in such a manner that first centerline 115 is coplanar with and intersects second centerline 113 at a reference point 109. First centerline 115 and second centerline 113 subtend a first obtuse angle 122.

A cylinder bore 108 intersects suction valve bore 110 and discharge valve bore 112, cylinder bore 108 having a proximal packing area 116, a right circular cylindrical area 114, and a distal transition area 118. Packing area 116 and right circular cylindrical area 114 each have substantially circular cross-sections and a (common) third centerline 76. Third centerline 76 intersects first centerline 115 and second centerline 113 at or near reference point 109. Second centerline 113 and third centerline 76 subtend a second obtuse angle 126, and first centerline 115 and third centerline 76 subtend a third obtuse angle 124. Transition area 118 has a distal elongated (in the illustrated case, oblong) crosssection seen at section B—B. The elongated cross-section is substantially perpendicular to third centerline 76 and has a long axis 119 substantially perpendicular to the plane of first centerline 115, second centerline 113, and third centerline 76. Internal edges corresponding to intersections of bores 110, 112 and 108 are chamfered 121.

Figure 10:
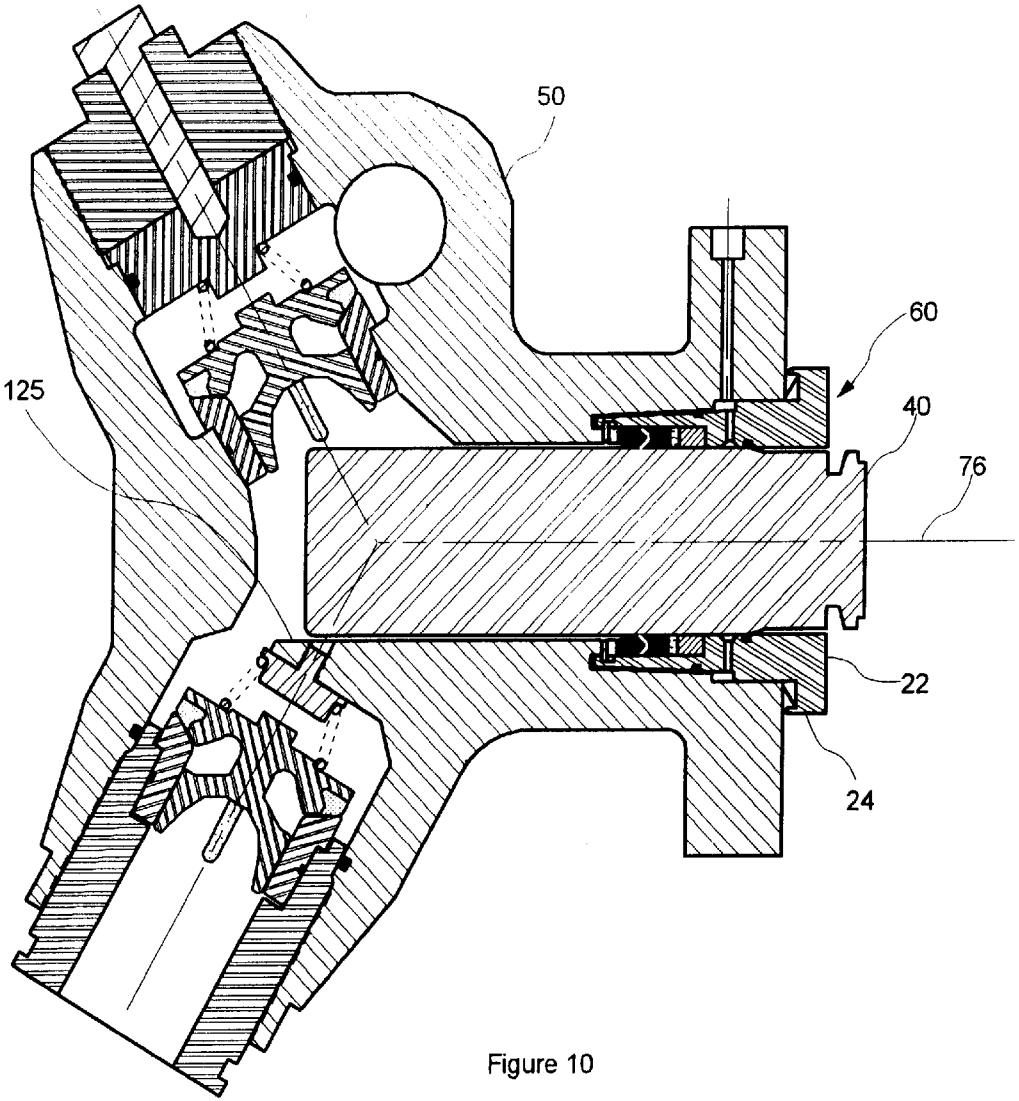
FIG. 10 schematically illustrates a Y-block plunger pump housing of the present invention incorporating an integral suction valve retainer arm and with a tapered packing cartridge and gland nut assembly in place over a one-piece plunger.
Figure 11:
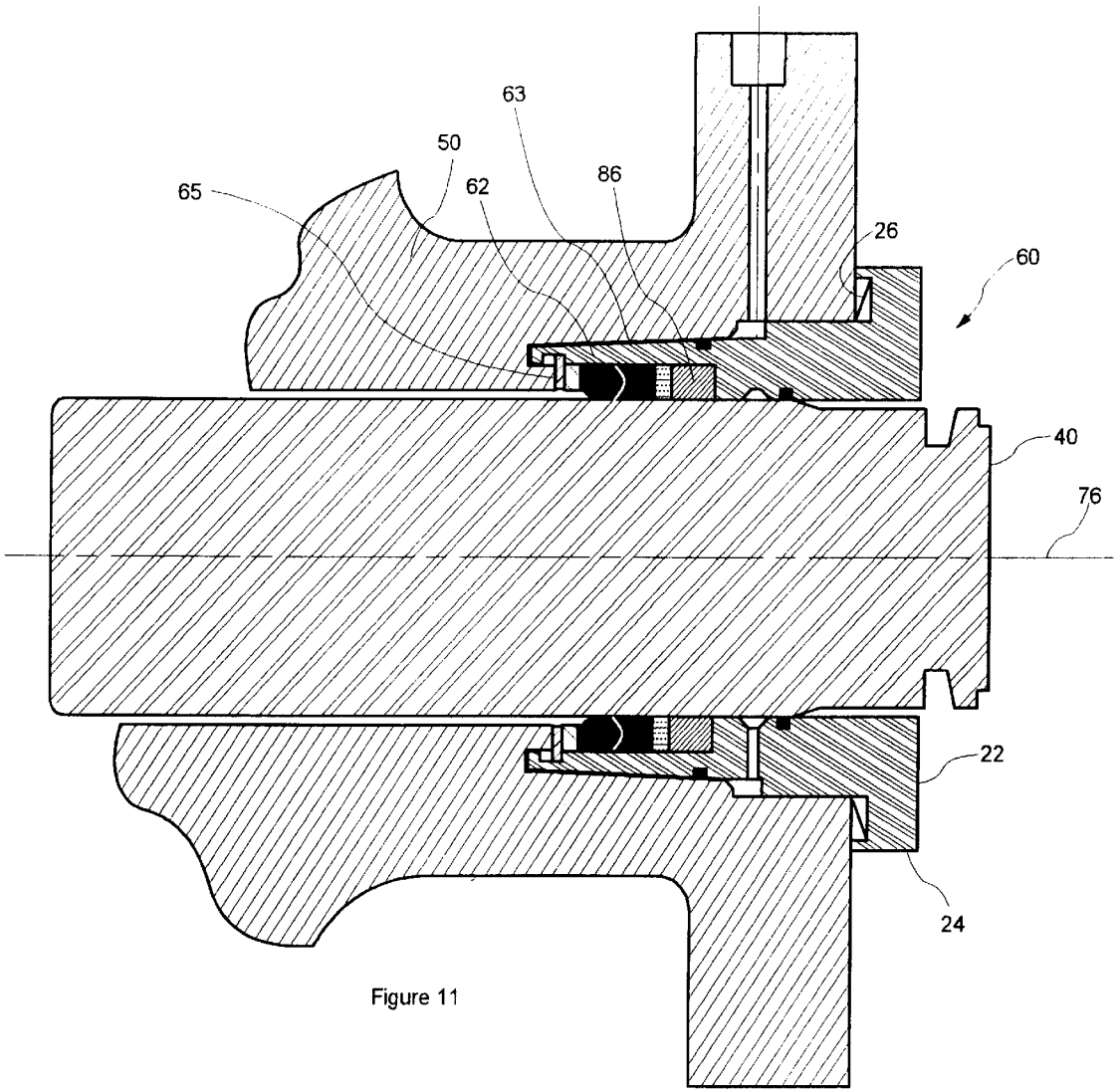
FIG. 11 schematically illustrates an enlarged partial cross-sectional view of a plunger pump housing as in FIG. 10, with a one-piece plunger and a tapered packing cartridge and gland nut assembly in place.
Figure 12:
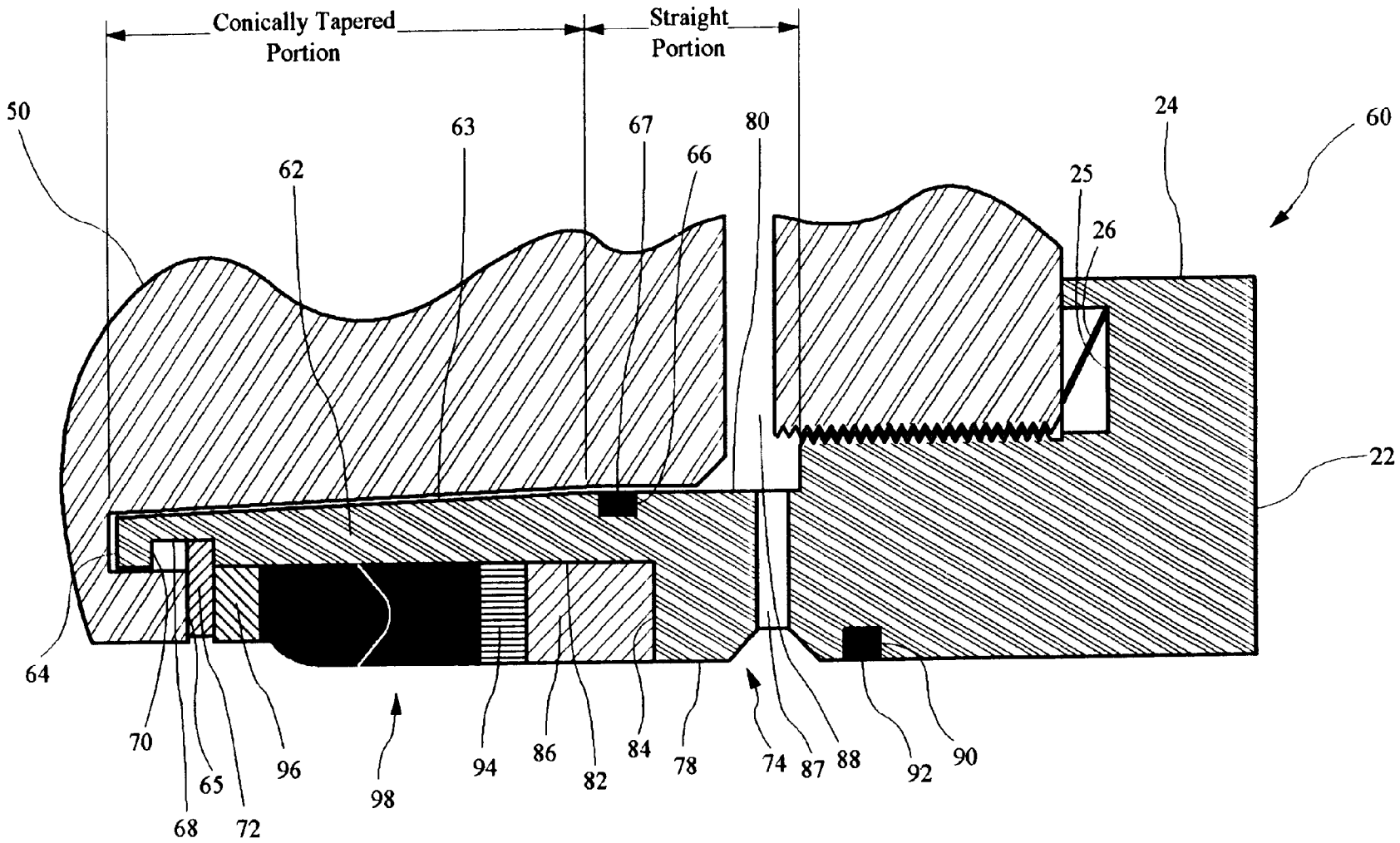
FIG. 12 schematically illustrates a further enlarged portion of FIG. 11, showing the extent of the right cylindrical outer surface portion of a tapered cartridge and gland nut assembly.

FIGS. 10, 11 and 12 schematically illustrate increasingly enlarged ( partial) cross-sections of a tapered cartridge packing and gland nut assembly 60 installed in a Y-block plunger pump housing 50 of the present invention. Assembly 60 comprises a packing cartridge housing 62 having a distal end 64, a longitudinal axis, and a proximal end 74, wherein the proximal end 74 is slightly distal to lubrication channel 87. When assembly 60 is installed in plunger pump housing 50, the longitudinal axis of packing cartridge housing 62 is colinear with the above third centerline 76 shown in the Figures.

Assembly 60 has a length between distal end 64 and proximal end 74, and a substantially right cylindrical inner surface 78 having a first diameter. A substantially coaxial right cylindrical outer surface 80 extends distally from proximal end 74 for a portion of said cartridge housing length, and a conically tapered substantially coaxial outer surface 63 extends distally from said distal extent of said right cylindrical outer surface 80 to distal end 64. As illustrated in FIGS. 10, 11 and 12, tapered outer surface 63 tapers distally from right cylindrical outer surface 80 toward longitudinal axis 76. Inner surface 78, has a substantially coaxial cylindrical recess 82 having a second diameter greater than said first diameter and extending from distal end 64 proximally to an internal bearing ring stop 84. Cylindrical recess 82 has a substantially coaxial internal snap ring groove 68, groove 68 having a substantially uniform width and a third diameter greater than said second diameter.

A threaded gland nut 22 is integral with proximal end 74 of packing cartridge housing 62. Gland nut 22 comprises a shoulder 24, a shoulder seal groove 25 and an internal seal groove 90. A seal 26 lies within seal groove 25 for sealing shoulder 24 against a plunger pump housing. A seal 92 fitted within internal seal groove 90 of gland nut 22 for sealing against a plunger.

Figure 14:
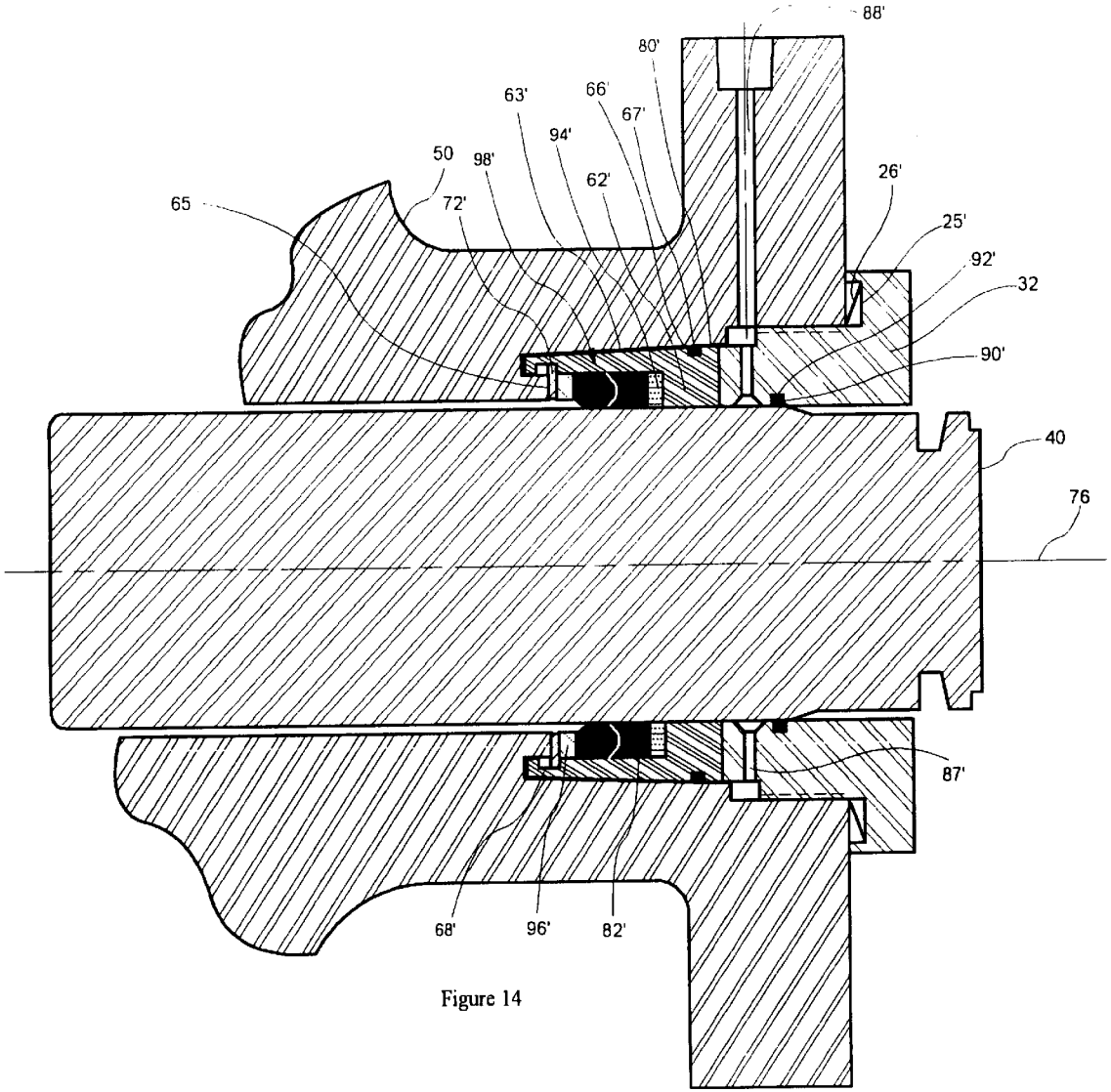
FIG. 14 schematically illustrates a partial cross-sectional view of a plunger pump housing of the present invention with a plunger, a tapered packing cartridge assembly, and a (separable) gland nut in place.

Several structures of assembly 60 above correspond to analogous structures in the embodiment of the invention schematically illustrated in FIG. 14. Certain analogous structures in FIG. 14, which illustrates a tapered cartridge packing housing 62' used with a separate (removable) gland nut 32, have primed numerical labels as indicated.

At least one and preferably a plurality of radial lubricating channels 88, 88' in housing 50 communicate with at least one and preferably a plurality of corresponding channels 87,87' proximal to internal bearing ring stop 84, allowing for lubrication of a plunger within packing cartridge housing 62, 62'. After entering through channels 88,88' and 87,87', plunger lubricant is prevented from leaking distally by elastomeric seal 67,67' and packing ring 98,98', while elastomeric seal 92,92' and seal 26,26' (preferably a bellville spring) prevent proximal leakage.

At least one circumferential seal groove 66,66' lies in right cylindrical outer surface 80,80', and an elastomeric seal 67,67' is fitted within each circumferential seal groove 66,66' to seal against fluid leakage around the outer surfaces of cartridge packing housing 62,62'.

A substantially coaxial bearing ring 86 lies within cylindrical recess 82,82' and contacts internal bearing ring stop 84. Bearing ring 86 has an inner diameter slightly less than said first diameter and an outer diameter substantially equal to said second diameter. A substantially coaxial anti-extrusion ring 94,94' also lies within cylindrical recess 82 and contacts bearing ring 86. Anti-extrusion ring 94,94' comprises a deformable material having a close sliding fit over a plunger within assembly 60. Hence, the inner diameter of ring 94,94' is slightly less than said first diameter and its outer diameter is about equal to said second diameter.

A substantially coaxial snap ring 72,72' lies within snap ring groove 6868' and has a thickness less than said snap ring groove width. Snap ring 72,72' has an inner diameter slightly greater than said first diameter, an outer diameter slightly less than said third diameter, and a longitudinal sliding fit within snap ring groove 68,68'. A substantially coaxial packing compression ring 96,96' is positioned within cylindrical recess 82,82', between snap ring 72,72' and anti-extrusion ring 94,94' and contacting snap ring 72,72'. Packing compression ring 96,96' has an inner diameter slightly greater than said first diameter and an outer diameter slightly less than said second diameter.

A substantially coaxial packing ring 98,98' lies within cylindrical recess 82,82'. Packing ring 98,98' has an inner diameter substantially equal to said first diameter, an outer diameter substantially equal to said second diameter, and sufficient length to substantially fill cylindrical recess 82,82' between anti-extrusion ring 94,94' and packing compression ring 96,96' when snap ring 72,72' is positioned maximally distally within snap ring groove 68,68'. Note that coaxial packing ring 98,98' may comprise one or more coaxial component rings arranged longitudinally (that is, stacked like washers). As an example of a preferred embodiment, two such component rings are schematically illustrated in FIGS. 10–12 and 14.

As assembly 60 is advanced distally in Y-block plunger pump housing 50, snap ring 72 encounters adjusting ring 65, which is a coaxial boss integral with housing 50. Continued distal advancement of assembly 60 will cause snap ring 72 to move proximally (longitudinally) within snap ring groove 68. In turn, proximally directed longitudinal sliding movement of snap ring 72 within snap ring groove 68 causes proximally directed longitudinal sliding movement of packing compression ring 96 with resultant compression of packing ring 98 and tighter sealing of the packing around a plunger lying within cartridge packing housing 62. Analogous sealing occurs with distal advancement due to tightening of gland nut 32 as shown in FIG. 14.

Conversely, if distally directed sliding movement of snap ring 72 within snap ring groove 68 is allowed, as during extraction of tapered cartridge packing and gland nut assembly 60 from a Y-block plunger pump housing 50, compressed packing ring 98 will tend to push snap ring 72 distally so as to relieve the compression. Such compression relief in packing ring 98 will loosen the seal of packing ring 98 around a plunger lying within cartridge packing housing 62, facilitating continued extraction of assembly 60. Analogous loosening occurs when gland nut 32 as shown in FIG. 14 is backed out of housing 50.

Figure 13:
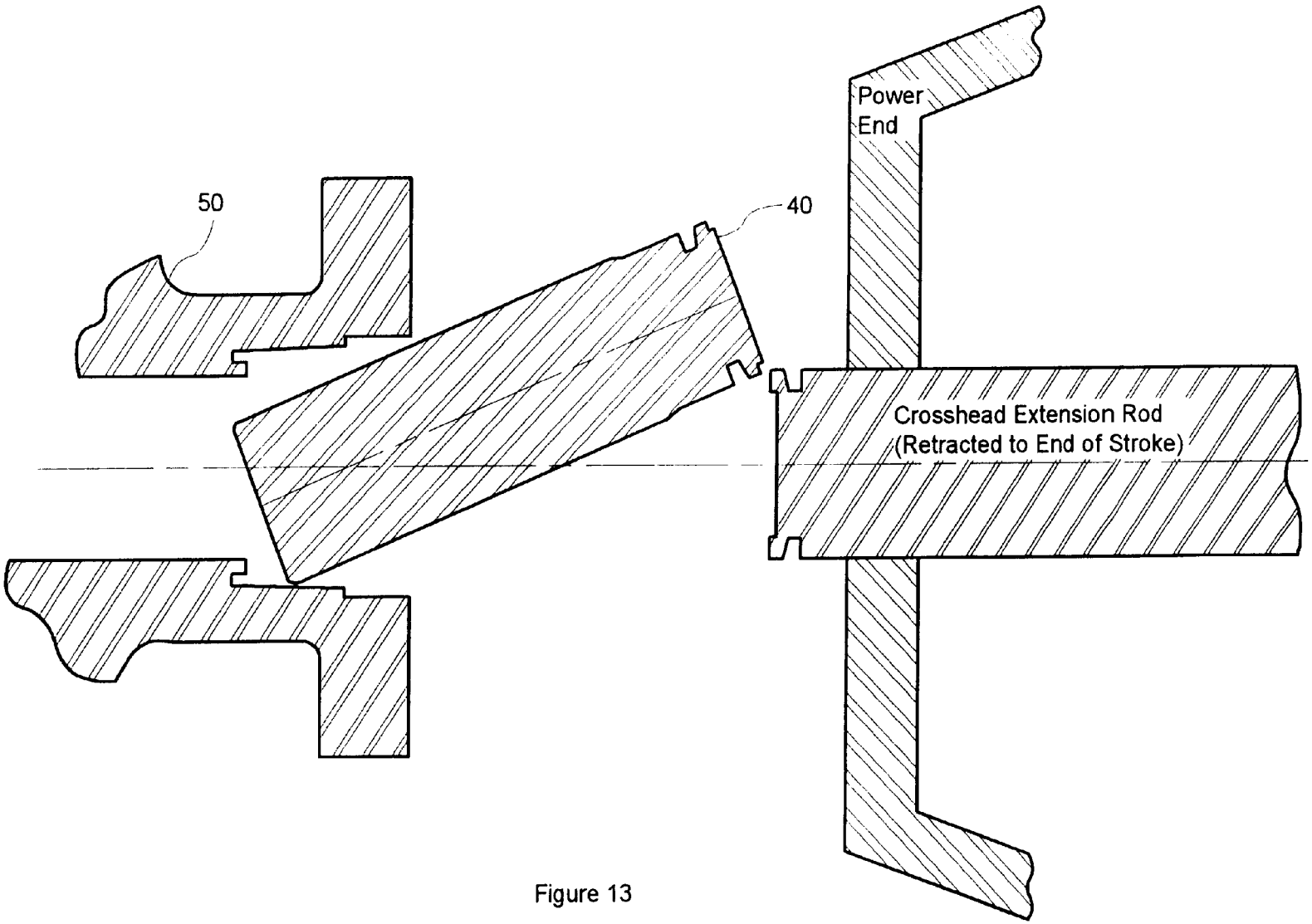
FIG. 13 schematically illustrates rotation of a plunger for insertion or removal in a Y-block plunger pump housing as in FIG. 9.

Following extraction of assembly 60 from plunger pump housing 50, a plunger 40 may be removed from plunger pump housing 50 as schematically illustrated in FIG. 13. As shown in FIG. 13, prior extraction of assembly 60 allows subsequent rotation of plunger 40 into space formerly occupied by assembly 60. This rotation provides sufficient clearance for removal of plunger 40 past power section components.

FIG. 14 is analogous to FIG. 11 but differs in that it schematically illustrates an embodiment of the invention wherein gland nut 22, an integral part of tapered cartridge packing and gland nut assembly 60, is replaced by removable gland nut 32. Note that tapered cartridge packing housing 62' in FIG. 14 is made of bearing alloy and thus a separate bearing ring analogous to bearing ring 86 is not required. Note also that when gland nut 32 is removed from plunger pump housing 50, leaving cartridge packing housing 62' in place, proximal traction on plunger 40 will be required to extract housing 62' from plunger pump housing 50. In this configuration, cartridge packing housing 62' will tend to follow plunger 40 as it is withdrawn proximally because the friction of packing ring 98' on a proximally moving plunger 40 will exceed the friction of circumferential seal 67' on plunger pump housing 50.

Figure 15:
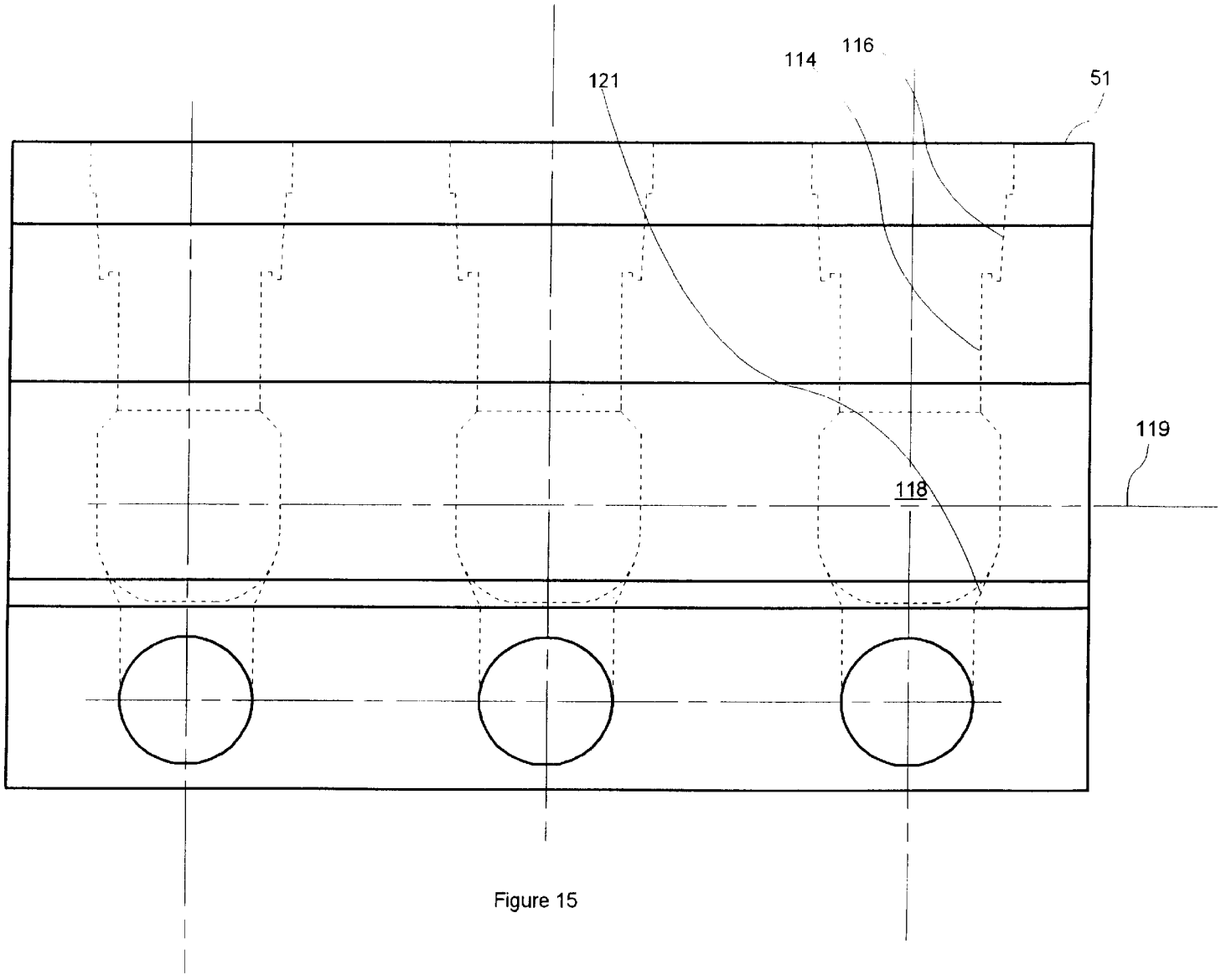
FIG. 15 schematically illustrates a top view of a 3-section Y-block plunger pump housing of the present invention.

FIG. 15 schematically illustrates a top view of plunger pump housing 51 of the present invention, housing 51 being analogous to housing 50 except that housing 51 is capable of accommodating three plungers. Discharge bores 112 are directly visible, and phantom (dotted) lines show the internal elongated bores 118.

What is claimed is:

1. A Y-block plunger pump housing comprising:

a suction valve bore having a substantially circular cross-section and a first centerline;

a discharge valve bore intersecting said suction valve bore, said discharge valve bore having a substantially circular cross-section and a second centerline, said first centerline being coplanar with and intersecting said second centerline, said first and second centerlines subtending a first obtuse angle; and a cylinder bore intersecting said suction valve bore and said discharge valve bore, said cylinder bore having a proximal packing area and a distal transition area, said packing area having a substantially circular cross-section and a third centerline, said third centerline being coplanar with and intersecting said first and second centerlines to allow substantially unimpeded fluid flow from said suction bore to said discharge bore under the influence of reciprocating plunger movement in said cylinder bore, said second and third centerlines subtending a second obtuse angle, and said first and third centerlines subtending a third obtuse angle;

wherein said transition area has a distal elongated cross-section substantially perpendicular to said third centerline and with a long axis substantially perpendicular to said plane of said first and second centerlines.

2. The pump housing of claim 1 wherein said first, second and third obtuse angles are each substantially equal to 120 degrees.

3. The pump housing of claim 1 wherein internal edges corresponding to bore intersections are chamfered.

4. The pump housing of claim 1 wherein said proximal packing area and said distal transition area each occupy approximately one-half of said cylinder bore.

5. The pump housing of claim 1 wherein said distal elongated transition area cross-section is elliptical.

6. The pump housing of claim 1 wherein said distal elongated transition area cross-section is oblong.

7. The pump housing of claim 1 wherein said transition area has a proximal substantially circular cross-section perpendicular to said third centerline, said transition area cross-section changing smoothly from substantially circular to elongated from proximal to distal.

8. A tapered cartridge packing assembly comprising a packing cartridge housing having, a distal end, a proximal end, a longitudinal axis, a length between said distal and proximal ends, a substantially right cylindrical inner surface having a first diameter, a substantially coaxial right cylindrical outer surface extending distally from said proximal end for a portion of said cartridge housing length, and a conically tapered substantially coaxial outer surface extending distally from said distal extent of said right cylindrical outer surface to said cartridge housing distal end, said tapered outer surface tapering distally from said right cylindrical outer surface toward said longitudinal axis, said inner surface having a substantially coaxial cylindrical recess having a second diameter greater than said first diameter and extending from said distal end proximally to an internal bearing ring stop, and said cylindrical recess having a substantially coaxial internal snap ring groove, said groove having a substantially uniform width and a third diameter greater than said second diameter;

at least one circumferential seal groove in said right cylindrical outer surface;

an elastomeric seal fitted within each said circumferential seal groove;

a substantially coaxial bearing ring having an inner diameter slightly less than said first diameter and an outer diameter about equal to said second diameter, said bearing ring contacting said bearing ring stop;

a substantially coaxial anti-extrusion ring having an inner diameter slightly less than said first diameter and an outer diameter about equal to said second diameter, said anti-extrusion ring contacting said bearing ring;

a substantially coaxial snap ring having a thickness less than said snap ring groove width, an inner diameter slightly greater than said first diameter, and an outer diameter slightly less than said third diameter, said snap ring having a longitudinal sliding fit within said snap ring groove;

a substantially coaxial packing compression ring having an inner diameter slightly greater than said first diameter, an outer diameter slightly less than said second diameter, and a thickness greater than said snap ring groove width less said snap ring thickness, said packing compression ring being positioned between said snap ring and said anti-extrusion ring and contacting said snap ring; and a substantially coaxial packing ring within said cylindrical recess, said packing ring having an inner diameter substantially equal to said first diameter and an outer diameter substantially equal to said second diameter and sufficient length to substantially fill said recess between said anti-extrusion ring and said packing compression ring when said snap ring is positioned maximally distally within said snap ring groove, wherein proximally directed longitudinal sliding movement of said snap ring within said snap ring groove causes proximally directed longitudinal sliding movement of said packing compression ring with resultant compression of said packing.

9. The tapered cartridge packing assembly of claim 8 wherein said conical taper is 0.5 to 3°.

10. A tapered cartridge packing and gland nut assembly comprising:

a packing cartridge housing having a distal end, a proximal end, a longitudinal axis, a length between said distal and proximal ends, a substantially right cylindrical inner surface having a first diameter, a substantially coaxial right cylindrical outer surface extending distally from said proximal end for a portion of said cartridge housing length, and a conically tapered substantially coaxial outer surface extending distally from said distal extent of said right cylindrical outer surface to said cartridge housing distal end, said tapered outer surface tapering distally from said right cylindrical outer surface toward said longitudinal axis, said inner surface having a substantially coaxial cylindrical recess having a second diameter greater than said first diameter and extending from said distal end proximally to an internal anti-extrusion ring stop, and said cylindrical recess having a substantially coaxial internal snap ring groove, said groove having a substantially uniform width and a third diameter greater than said second diameter;

at least one radial lubrication channel proximal to said internal anti-extrusion ring stop;

a threaded gland nut integral with said proximal end of said packing cartridge housing, said gland nut comprising a shoulder, a shoulder seal groove and an internal seal groove proximal to said at least one lubrication channel;

a seal fitted within said shoulder seal groove for sealing said shoulder against a plunger pump housing;

a seal fitted within said internal seal groove for sealing against a plunger;

at least one circumferential seal groove in said right cylindrical outer surface;

an elastomeric seal fitted within each said circumferential seal groove;

a substantially coaxial anti-extrusion ring having an inner diameter slightly less than said first diameter and an outer diameter substantially equal to said second diameter, said anti-extrusion ring contacting said anti-extrusion ring stop;

a substantially coaxial snap ring having a thickness less than said snap ring groove width, an inner diameter slightly greater than said first diameter, and an outer diameter slightly less than said third diameter, said snap ring having a longitudinal sliding fit within said snap ring groove;

a substantially coaxial packing compression ring having an inner diameter slightly greater than said first diameter and an outer diameter slightly less than said second diameter, said packing compression ring positioned between said snap ring and said anti-extrusion ring and contacting said snap ring; and a substantially coaxial packing ring within said cylindrical recess, said packing ring having an inner diameter substantially equal to said first diameter and an outer diameter substantially equal to said second diameter and sufficient length to substantially fill said recess between said anti-extrusion ring and said packing compression ring when said snap ring is positioned maximally distally within said snap ring groove, wherein proximally directed longitudinal sliding movement of said snap ring within said snap ring groove causes proximally directed longitudinal sliding movement of said packing compression ring with resultant compression of said packing.

11. The tapered cartridge packing and gland nut assembly of claim 10, additionally comprising a bellville spring for sealing said gland nut shoulder against a plunger pump housing.

12. The tapered cartridge packing and gland nut assembly of claim 10 wherein said conical taper is between 0.5 and 3.0 degrees.

* * * * *